United States Patent [19]

Colby

[11] Patent Number: 4,801,022

[45] Date of Patent: Jan. 31, 1989

[54] MAIL, CARD AND PHOTOGRAPH DISPLAY, STORAGE AND RETRIEVAL RACK

[76] Inventor: Kevin T. Colby, 715 Smith St., Ft. Collins, Colo. 80524

[21] Appl. No.: 99,156

[22] Filed: Sep. 21, 1987

[51] Int. Cl.[4] ..... A47F 7/00

[52] U.S. Cl. ..... 211/50; 211/10; 211/11; 211/45

[58] Field of Search ..... 211/10, 11, 45, 40

[56] References Cited

U.S. PATENT DOCUMENTS

| | | | |
|---|---|---|---|
| 386,673 | 7/1888 | Wells | 211/11 |
| 1,593,326 | 7/1926 | Bourn | 211/10 X |
| 1,772,438 | 8/1930 | Cubberley | 211/11 |
| 2,268,927 | 1/1942 | Demme | 211/45 |
| 3,185,307 | 5/1965 | Higgins | 211/40 |
| 3,195,732 | 7/1965 | Schwartz | 211/40 |

FOREIGN PATENT DOCUMENTS

| | | | |
|---|---|---|---|
| 224358 | 4/1962 | Austria | 211/40 |
| 673385 | 11/1963 | Canada | 211/40 |

*Primary Examiner*—Robert W. Gibson, Jr.

[57] ABSTRACT

A rack device for the storage, display, retrieval and replacement of articles of substantially two-dimensions with like shapes but of different contents like items of mail, cards or photographs and similar articles. The device is comprised of a support frame holding two substantially different mechanisms that comprise the device and retain said articles. One mechanism consists of a shelf that extends between the two sides of the support frame and contains vertical elements for the support of said articles. Another mechanism of the device is a removeable rod located below the aforementioned shelf and extending between the sides whereby said articles are suspended from this rod. The device may be employed as a free-standing device or may be flush-mounted on a vertical surface.

4 Claims, 2 Drawing Sheets

MAIL, CARD AND PHOTOGRAPH DISPLAY, STORAGE AND RETRIEVAL RACK

BACKGROUND OF THE INVENTION (a) Field of Invention

The present invention relates to an organizer device for storing and displaying articles which are substantially two-dimensional, of like shape and configurations and containing information different for one another, and more specifically to a rack for carrying a plurality of items of mail, cards, photographs or like articles.

(b) Description of Prior Art

Mail storage devices are well known. U.S. Pat. No. 1,593,326 includes partitions to hold mail vertically and U.S. Pat. No. 386,673 incorporates similar partitions for the vertical support of paper or bills and U.S. Pat. No. 1,772,438 includes similar partitions to hold heavy items in a vertical position.

Racks employing a horizontal rod for the storage of phonograph records are cited in Canadian Patent No. 673,385 and Austrian Patent No. 224,358.

Storage devices of the first type mentioned, those with vertical partitions are often of inappropriate configurations or dimensions for use in the environment intentioned for the device covered in the applicants' invention which is the home environment while mechanisms employing a horizontal rod are not employed to serve the same function as that of the applicants invention but for phonograph records and wallpaper. Moreover no device combines these two elements—vertical components and horizontal rod—in one invention for the use in the home for substantially two-dimensional articles like mail, cards or photographs.

Devices that do offer storage, retrieval and display specifically for mail, cards and photographs and like items to those provided for in the applicants invention are of two kinds widely disimmilar to those cited in the aforementioned patents and the applicants invention. The two kinds are also dissimilar to each other. The first kind is that employed by retail outlets for the display of cards for sale. In this first kind of device cards of different types are placed side by side horizontally and above or below each other vertically in order that the face of the card be displayed.

The second kind is that in which cards or photographs are inserted into a book or album where they are affixed to the pages of that book or album. Both kinds are very dissimilar to the invention covered in the application applied for. The first takes up a large amount of space for the number of cards displayed and the second kind does not provide for ready access or retrieval—dissadvantages that are corrected in the applicants invention.

SUMMARY OF THE INVENTION

It is an object of the present invention to overcome the above-mentioned shortcomings and to provide for a combination of the two elements—the vertical support components and the horizontal rod—at an appropriate scale for use in the home.

Another object of the present invention is to provide an improved storage rack that is simple in structure and reliable.

A further object of the present invention is to provide for the storing of a maximum of said articles in a minimum amount of space.

Another object of the present invention is to provide an organizer which is easy to use and which provides for the ready modification of the stored articles.

Another object of the present invention is to provide an attractive device that will be an aesthetically attractive addition to the home.

Another object of the present invention is to provide for wall-mounting the device or to use the device as a free-standing structure.

According to the above objects, from a broad aspect, the present invention provides an organization device for storage, display, retrieval and replacement of closely spaced articles of substantially like-shape but of different contents.

In accordance with the present invention, the foregoing objects are provided by a framework supporting a shelf with vertical elements to hold articles in a horizontal or vertical position, and a rod suspended between the two sides of the framework and below the shelf from which the articles can also be suspended.

Other and further objects will be obvious upon an understanding of the illustrative embodiment about to be described or will be indicated in the appended claims.

BRIEF DESCRIPTION OF THE DRAWINGS

A preferred embodiment of the invention will now be described with reference to the accompanying drawings wherein.

DESCRIPTION OF PREFERRED EMBODIMENT

Figure 5:
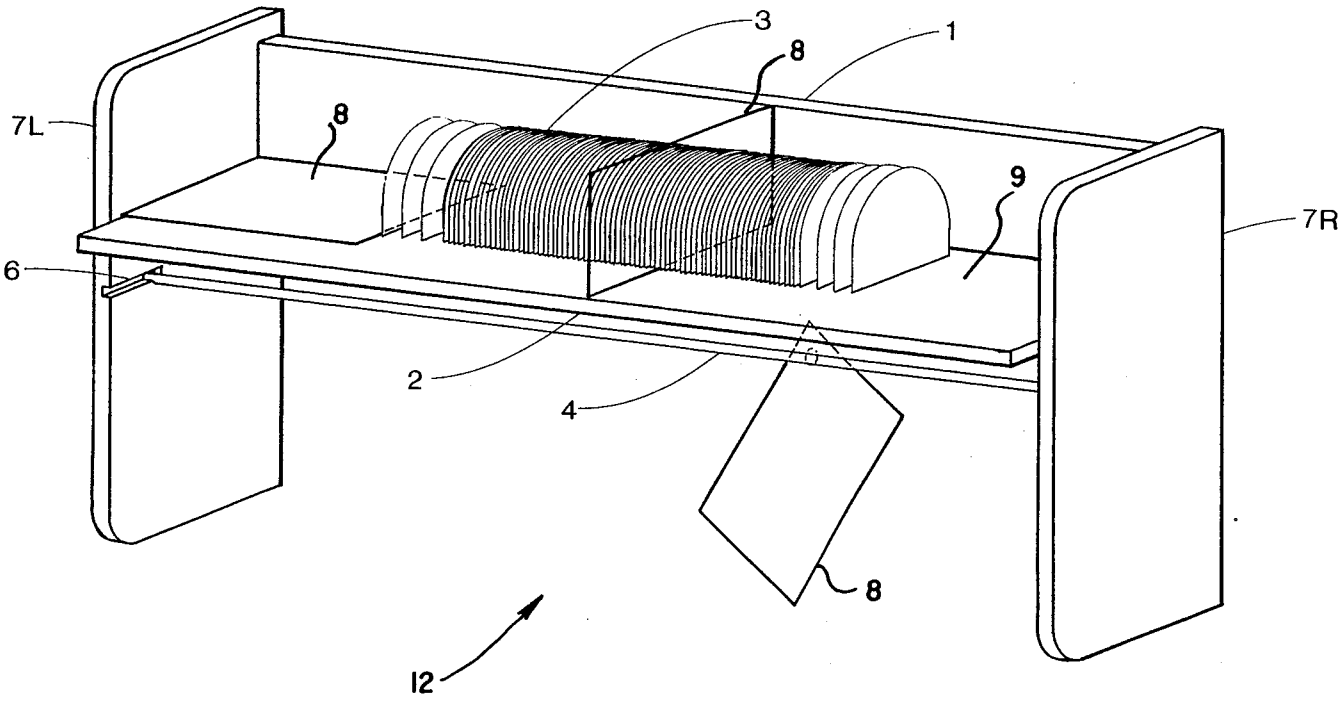
FIG. 5 is a perspective view of an embodiment of the invention.

Referring now to the drawings and more particularly FIG. 5, there is shown generally at 12 the device of the present invention for the storage, display and retrieval of closely spaced articles of substantially like-shape configuration but having different contents such as mail, cards or photographs (8). The device 12 comprises a vertical support framework consisting of vertical side walls(7L & 7R), a vertical back wall(1) and a horizontal shelf(2) extends transversely between the vertical side walls along the base of the back wall(1).

Holding means in the top portion of the invention on the aforementioned shelf are provided by the horizontal spaces at the ends of the shelf(9) and by a plurality of closely spaced vertical elements(3) in the midsection of the shelf. In this particular embodiment the aforementioned vertical elements are of sufficient height, width and strength to hold the aforementioned articles(8). The vertical elements are attached to a base(10) that extends from the back(1) to the front and side edges of the vertical elements in a monolithic structure made of plastic material. This monolithic piece is flush-monted to the shelf.

In operation articles can be grasped and placed onto, or retrieved from any appropriate horizontal or vertical position on the shelf.

Holding means in the lower portion of the device is provided by the horizontal rod(4) that runs transversely between the sides(7L & 7R). The rod is seated with one end in a cylinder-shaped hole(5) shown in FIG. 1,2, & 4 beginning on the inside of the right side and extending one-half of the width of the side and of a slightly larger diameter than the rod. The other end is seated in a half-cylinder-shaped hole at the end bottom of a channel(6). The width of the channel and the diameter of the hole are slightly larger that that of the rod. The channel with its hole begins on the inside of the left side(7L) and extend into the side one-half the width of the side.

Figure 3:
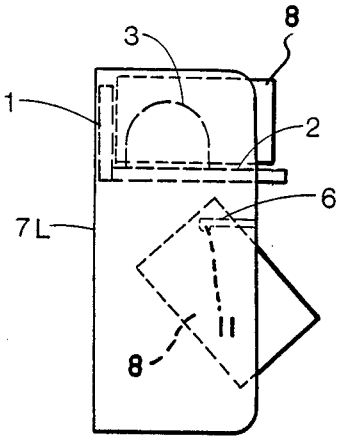
FIG. 3 is a left elevational view showing the abovementioned elements.
Figure 4:
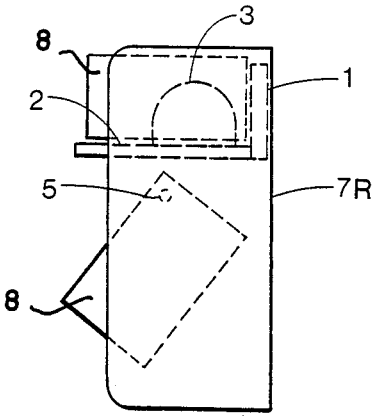
FIG. 4 is a right elevational view showing the abovementioned elements.

Referring to FIG. 3 there is shown the aforementioned hole(11) at the end bottom of the channel(6).

In operation the rod is grasped on the left side and lifted out of the hole(11) and slid out of the channel(6). An article of mail, a card or a photograph is then slid onto the rod by means of a hole of slightly larger diameter than that of the rod that has been punched in the aforementioned article. By this means said articles(8) are suspended vertically from the rod(4). The left end of the rod is then placed back in the channel(6) and seated in the hole(11) and restored to its normal resting horizontal position(4). Articles so suspended from the rod can be slid to and fro and any article of particular interest can be grasped and rotated on the rod to a normal reading position.

Figure 1:
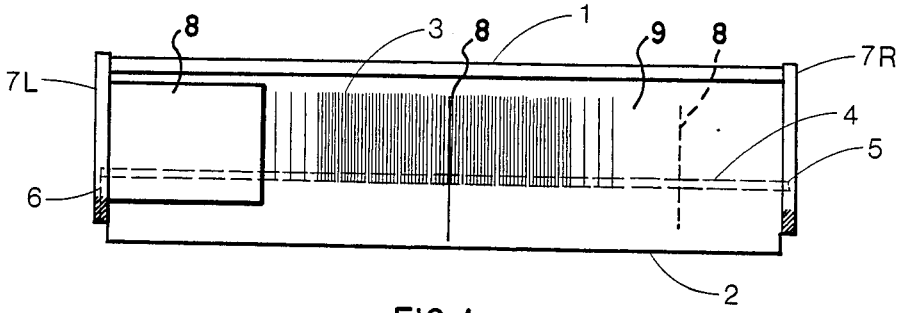
FIG. 1 is a top view showing the supporting framework with the shelf and the vertical elements of the shelf and the horizontal rod beneath the shelf.
Figure 2:
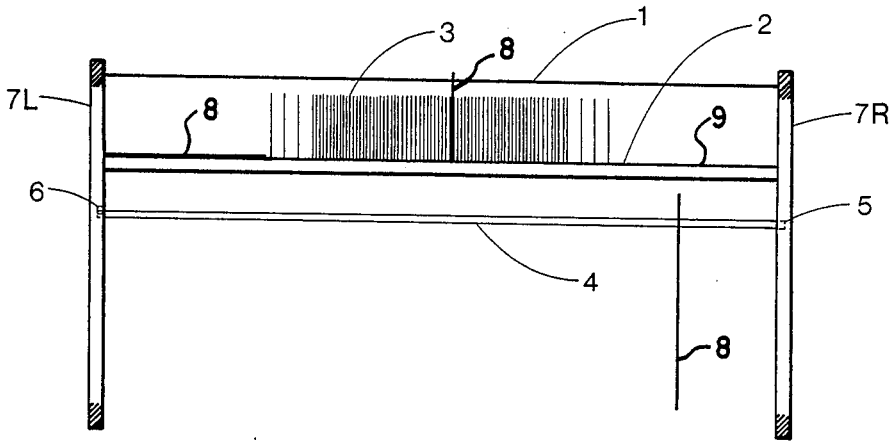
FIG. 2 is a front elevational view showing the abovementioned elements.

Referring to FIG. 1,3 & 4 there is shown that the back is recessed from the sides to afford flush-mounting on a vertical surface; however the device is designed to function as a free-standing unit as well with support being afforded by the bottom edges of the sides(7L & 7R).

Shown above in the drawings and descriptions is one embodiment of the invention applied for which is approximately 25"×13"×6". These specifics should not be construed as limiting the scope of the invention. Variations in construction, construction materials, shapes or proportions can exist in mechanisms that provide the same function and are covered in the patent applied for.

In addition to variations in construction materials, shapes and proportions there can be variations that can be specifically cited. Such variations can consist of a mechanism which eliminates one of the two article-holding elements cited—either the shelf with its vertical elements or the rod whereby the mechanism would contain solely the remaining device. Also variations in rod movement can be cited—for example a rod hinged at one end and with a clasp at the other end. There can also be variations in the portion of the mechanism that holds and displays the articles upright on the shelf—for example the upright comb-like device can consist of vertical elements of any polygonal shape and the spacing of the elements can vary.

Accordingly the scope of the invention should be determined not by the embodiment illustrated but by the following claims and their legal equivalents.

I claim:

1. A rack or organizer for storage, display, retrieval and replacement of two-dimensional articles like mail, cards or photographs of substantially similar shape but of different contents said device comprising in combination a support frame having opposed vertical side walls, a vertical back wall and a horizontal shelf; said shelf contains a plurality of closely spaced vertical elements of sufficient dimension and strength for the support of said articles; a removable horizontal rod extending between the two vertical side walls below the said shelf.

2. A rack in accordance with claim 1 wherein said vertical elements on said shelf consist of plastic material of sufficient dimensions and strength to support and retain said articles, attached to a base extending to the back wall of the device and to the limits of said vertical elements in the three remaining directions on the shelf surface in a monolithic structure flush-mounted to the surface of said shelf.

3. A rack in accordance with claim 1 wherein the removable horizontal rod is seated with one end in a hole of slightly larger diameter than that of the rod and that extends one-half way of the total thickness of the right side wall from the inside surface of said side wall and the other end of the rod is seated in a half-cylinder-shaped hole of slightly larger diameter than the rod at the end bottom of a channel of slightly larger width than the diameter of the rod that extends one-half way of the total thickness of the left side wall into the inside of the said left side wall and extends in a direction at right angle from that just mentioned a distance from the front edge of the left side wall that is equal to the distance in from the right side wall that defines the location of the full-cylinder-shaped hole on the aforementioned right side so that the half-cylinder-shaped hole on the left side is directly opposite the full-cylinder-shaped hole on the right side.

4. A rack in accordance with claim 1 wherein the function of the invention can be provided by a free-standing device supported by the bottom edges of the sides or by flush-mounting on a vertical surface afforded by the back of the invention which is recessed to allow for the placement of one type of many commercially available hangers.

* * * * *